US005820436A

United States Patent [19]

Pohlman

[11] Patent Number: 5,820,436

[45] Date of Patent: Oct. 13, 1998

[54] CARRYING CASE WITH APERTURED LID FOR MOUNTING MODELS CONSTRUCTED OF BUILDING SYSTEMS COMPONENTS

[75] Inventor: Joe K. Pohlman, Los Angeles, Calif.

[73] Assignee: Mattel, Inc., El Segundo, Calif.

[21] Appl. No.: 797,744

[22] Filed: Feb. 7, 1997

[51] Int. Cl.[6] ..... A63H 33/04

[52] U.S. Cl. ..... 446/75; 446/118

[58] Field of Search ..... 446/75, 118, 126, 446/127

[56] References Cited

U.S. PATENT DOCUMENTS

| | | | |
|---|---|---|---|
| D. 355,763 | 2/1995 | Sun | D3/291 |
| D. 364,558 | 11/1995 | Guegan et al. | D9/341 |
| D. 374,771 | 10/1996 | Guegan et al. | D3/276 |
| 2,023,300 | 12/1935 | Barnett | 46/17 |
| 2,194,653 | 3/1940 | Gell | 446/118 |
| 4,551,110 | 11/1985 | Selvage et al. | 446/118 |
| 4,822,314 | 4/1989 | O'Brian et al. | 446/75 |
| 4,872,410 | 10/1989 | Lilly | 108/26 |
| 4,932,916 | 6/1990 | Blickle | 446/127 |
| 5,250,000 | 10/1993 | Boutin et al. | 446/75 |
| 5,474,483 | 12/1995 | Sun | 446/71 |

FOREIGN PATENT DOCUMENTS

| | | | |
|---|---|---|---|
| 2251494 | 4/1974 | Germany | 446/127 |
| 2252499 | 5/1974 | Germany | 446/118 |
| 221755 | 9/1924 | United Kingdom | 446/127 |
| 434972 | 9/1935 | United Kingdom | 446/127 |
| 1209843 | 10/1970 | United Kingdom | 446/127 |

*Primary Examiner*—Max Hindenburg
*Assistant Examiner*—Charles Marmor, II
*Attorney, Agent, or Firm*—Kolisch, Hartwell, Dickinson, McCormack & Heuser

[57] ABSTRACT

A carrying case provides a storage space for toy building system components which include couplers and building pieces. The case has a hinged lid with apertures which can detachably receive and lockably mount the couplers. The apertures are arranged in an array of staggered rows laid out so that couplers mounted on the lid can be interconnected by the building pieces. Models can be built upon the mounted couplers in a desired form and configuration. Each aperture on the lid is configured to receive a coupler peg in an insertion area. The peg includes a neck and a head. In order to lockably mount the coupler, it is shifted laterally from the insertion area, so that the peg neck moves through a transition channel and into a clasping area where the coupler is locked in position. The coupler cannot be removed vertically from the locked position because the peg head is trapped below the lid, compressing the lid between the coupler and the peg head. A U-shaped guide surrounds three sides of the aperture and butts up against a square shoulder on the coupler, aligning the coupler and preventing rotation of the coupler about a vertical axis. The coupler can be removed from the lid by shifting it in a reverse direction from the clasping area through the transition channel to the insertion area where it can be removed vertically.

11 Claims, 3 Drawing Sheets

CARRYING CASE WITH APERTURED LID FOR MOUNTING MODELS CONSTRUCTED OF BUILDING SYSTEMS COMPONENTS

BACKGROUND AND SUMMARY OF THE INVENTION

The present invention relates generally to cases for carrying components used in a toy building system. More particularly, it concerns a case useful not only for storing the components of the building system but also for providing a specially adapted work surface for the construction of models with the building system. In the carrying case of the present invention the work surface is provided on a lid provided with an array of apertures, each aperture configured to detachably receive and lockably mount a coupler. The coupler is one of the building system components configured so that the other building system components can be linked to the coupler. Children can build models, starting with couplers mounted in the lid, that are rigidly, but releasably, attached to the lid, and progressively add other building system components to construct a variety of toys, such as houses or bridges.

The carrying case of the present invention preferably includes a base with a storage space for the building system components. A lid is attached by hinges at an end of the base and a handle is coupled to the base and lid at an end opposite the hinges. Clasps are connected to the lid at the handle end for selectively closing the lid onto the base. The handle permits children or others to carry the case vertically like a briefcase. The case may also be set down on the hinged end when not in use.

When a child is building models, the case will ordinarily be placed flat on the base with the lid on top. In this position, the lid is available as a work surface and the building system components within the storage space are resting on the bottom of the base that extends between the hinged end and the handle end. The child may open the lid to remove components and close the lid to mount the couplers on an outer face of the lid. Alternatively, the child may also construct models on an inner face of the lid. The building pieces, i.e., the building system components other than the couplers, may be attached to the couplers. More couplers are attached to those building pieces, and more building pieces are attached to those couplers, and so on, as the child constructs the desired model.

A large variety of attachable building pieces are available, allowing the child to create an imaginative and changeable play environment including fixed structures mounted on the lid and moveable structures that can be moved over, under, and around the fixed structures. The fixed structures may include, for example, a bridge, or a rocket launching pad, while the moveable structure may be a truck that drives over the bridge or a rocket that takes off from the pad.

Surrounding each aperture are U-shaped guides that cooperate with shoulders on each coupler to align the coupler as the coupler is being mounted into position. The guides also prevent rotation about a vertical axis facilitating the interconnection of couplers with building pieces during the construction of models.

A significant advantage of the carrying case of the present invention is that the models can be fixedly mounted on the lid. The models can then be used in vigorous play without being knocked over. Also, the case itself forms a part of the constructed model and can be part of the imaginative play.

Another advantage of the invention is that models that are too large to fit in the storage space of the case may be mounted on the lid and transported along with the case without the need for disassembly or carrying separately. During transport, the case is usually carried by the handle with the lid extending vertically down from the handle. Because the models are fixedly mounted on the lid, they will not fall off when transported in this manner.

Another advantage is that the lid provides a work space for the child where a table may be unavailable. For example, while traveling in a car or airplane, the child can construct a model on the lid and, while doing so, keep the unused building pieces inside the case. The child can open the case to get more pieces without spilling the model onto the floor.

Another important aspect of the invention is the U-shaped guide which aligns the couplers and prevents rotation in the horizontal plane. This eases the task of mounting the couplers on the lid in an aligned manner and also makes the mounted couplers a more stable platform for further assembly of models.

A further advantage of the present invention is that the couplers are unitary, molded pieces with no moving parts. The couplers may be fixedly mounted on, and removed from, the lid without any requirement for additional hardware or manipulation of moving parts of the couplers.

These and additional objects and advantages of the present invention will be more readily understood after a consideration of the drawings and the detailed description of the preferred embodiment.

BRIEF DESCRIPTION OF THE DRAWINGS

FIG. 2 also shows that the underside of the lid also includes U-shaped guides around the apertures so that the apertures are identical whether viewed from an outer or inner face of the lid.

FIGS. 4*a*–14*d* are top plan views of the aperture which illustrate mounting the coupler in the aperture. FIG. 4*a* is a view showing the aperture's insertion area, transition channel, clasping area, and cutout area, a locking area adjacent the aperture, and the U-shaped guide.

DETAILED DESCRIPTION OF THE PREFERRED AND ALTERNATE EMBODIMENTS

Figure 1:
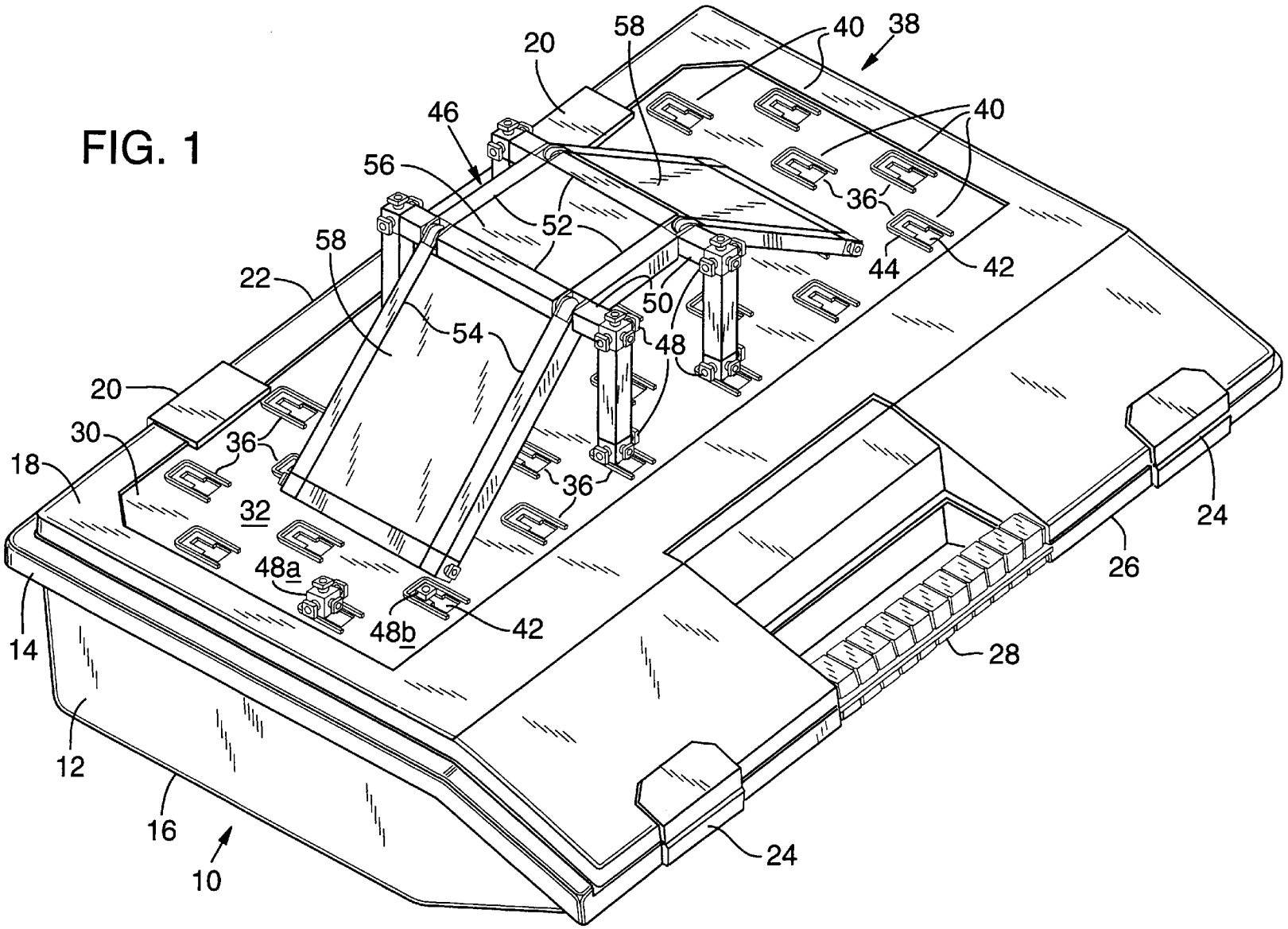
FIG. 1 is a perspective view of a carrying case with a lid according to the preferred embodiment of the present invention with a model, constructed from building system components, mounted on the lid. Also shown are a coupler mounted by itself on the outer side of the lid and another coupler mounted from the under side of the lid.

As shown in FIG. 1, a carrying case according to the present invention is generally indicated at 10. Case 10 provides storage for toy building system components, the case further having a lid upon which the components can be mounted to form models of desired form and configuration.

FIG. 1 shows that case 10, which is preferably made of plastic, includes a base 12 which has a rim 14 which extends all the way around the case. The rim can be used to lift and move case 10 when it is resting on a bottom 16 which is the usual attitude of the case when in use. A lid 18 is attached to base 12 by two hinges 20 located at an end 22 of the case and two clasps 24 located at an opposite end 26 of the case. The hinges and clasps attach to the base along rim 14. The base and the lid together provide an enclosure for storage of the components which include building pieces and couplers which will be described in more detail below.

A handle 28 is formed as part of the lid and base. The case may be carried by handle 28 with hinged end 22 closest to the ground and lid 18 vertical. This is the usual attitude for transporting the case.

Figure 2:
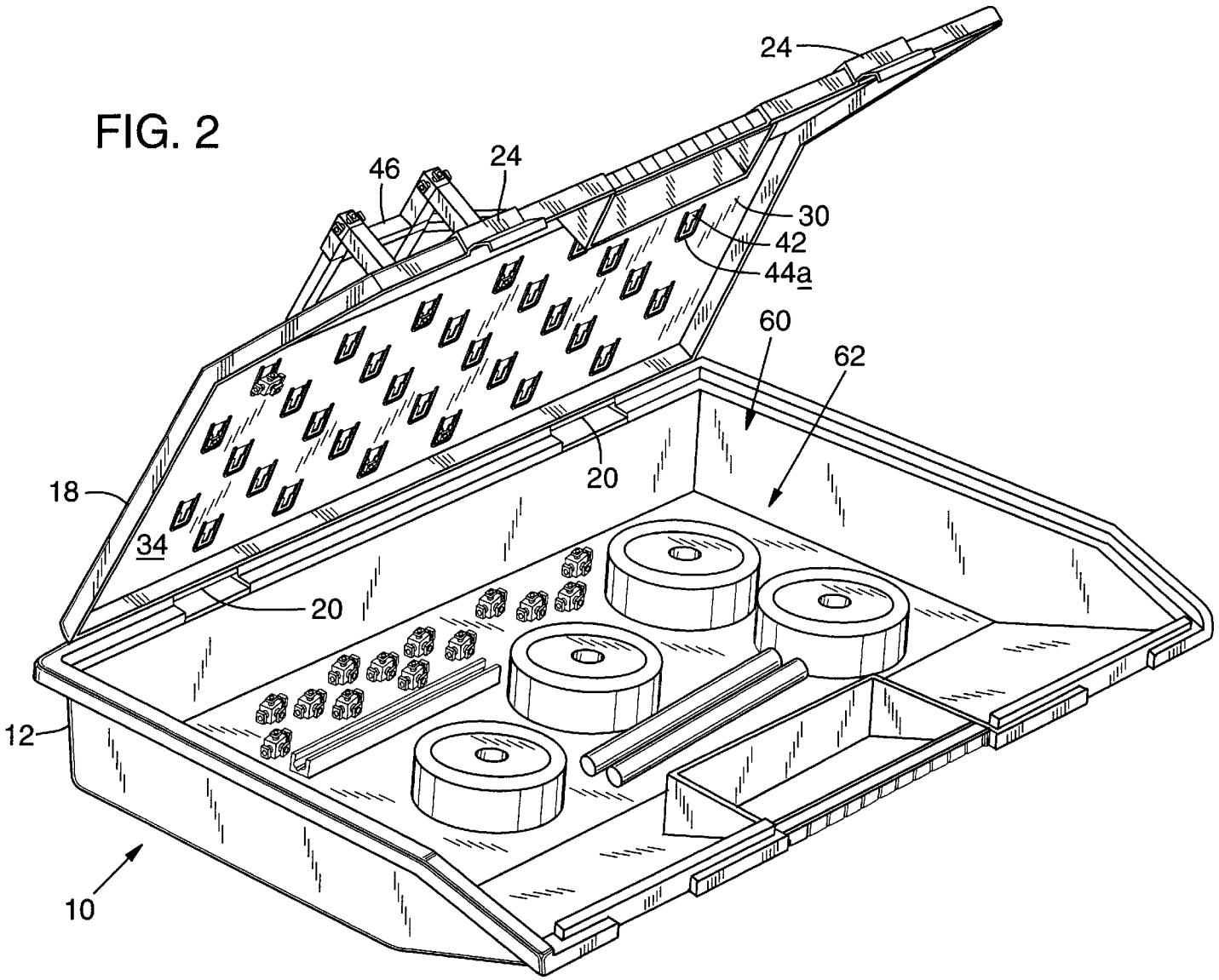
FIG. 2 is a perspective view of the carrying case with the mounted model and couplers as shown in FIG. 1 with the lid opened to show a storage space within the case and to illustrate that the model does not fall off when the lid is moved.

Lid 18 includes an expanse 30 with a first, outer face 32 and an opposed second, inner face 34 shown in FIG. 2. Expanse 30 includes a plurality of identical sites 36 for mounting couplers. Mounting sites 36 are arranged in an array, indicated generally at 38, of five staggered rows 40. Each mounting site includes a roughly keyhole-shaped aperture 42 extending through the expanse from the outer face to the inner face. Each aperture is surrounded on three sides by a U-shaped guide 44 formed of raised ribs on outer face 32.

A model, indicated generally at 46, is shown mounted on expanse 30. The model is constructed of a plurality of couplers 48 and building pieces including short spars 50, medium spars 52, long spars 54, a medium panel 56, and long panels 58. The spars attach to the couplers in a manner similar to that for the coupler's mounting on expanse 30 which will be described in detail below. The spars are made of various lengths but those lengths have been chosen, and mounting sites 36 are spaced apart on expanse 30, so that models may be constructed of spars of various shapes and size, yet, still fit properly on the mounting sites. For example, a long spar fits exactly between two couplers mounted on the expanse three rows apart while the same distance is spanned exactly by two short spars attached using two couplers at both ends of a medium spar. Similarly medium panels fit in the square formed by four medium spars and long panels fit in the rectangle formed by two medium and two long spars. Additional building system components (not shown) allow the construction of models in a nearly infinite variety of forms and configurations.

Also shown in FIG. 1 mounted on expanse 30 is a coupler 48*a,* similar to couplers 48 used in model 46, mounted by itself on outer face 32. A model may be constructed by adding building pieces, e.g., spars, to such a coupler. In addition, another similar coupler 48*b* has been mounted on inner face 34 of expanse 30 and can be seen extending through one of apertures 42. The case may also be used with the lid open with inner face 34 providing the work surface to construct models on.

FIG. 2 shows case 10 with clasps 24 detached from base 12 and lid 18 swung on hinges 20 to an open position. Although the lid is in a nearly vertical position, model 46 remains mounted on the lid. In fact, as will soon become apparent, considerable force could be exerted to pull the model away from the lid, but, save a structural failure of the plastic material of the lid or couplers, the model will remain mounted on the lid.

As seen in FIG. 2, the case includes a storage area 60 where unused building pieces and couplers, indicated generally at 62, are stored. As viewed on inner face 34 of expanse 30, apertures 42 appear identical as viewed on outer face 32. The inner face includes U-shaped guides 44*a* at each aperture 42 that are identical to guides 44 on the outer face. Thus, as noted above, the lid can be opened and the inner face used as a work surface in a manner similar to the outer face.

Figure 3:
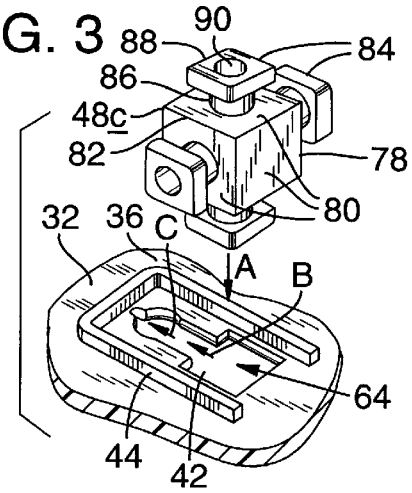
FIG. 3 is a perspective view of a single aperture and a coupler positioned above the aperture with arrows illustrating the path for inserting and securing the coupler.
Figure 4A:
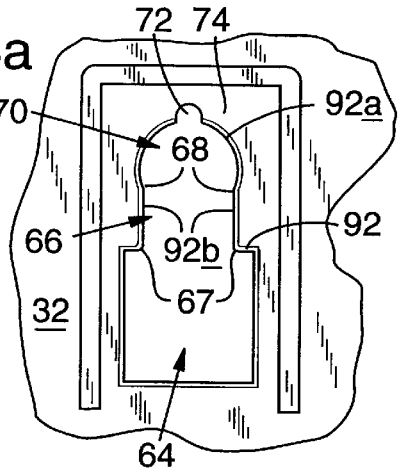
Figure 5B:
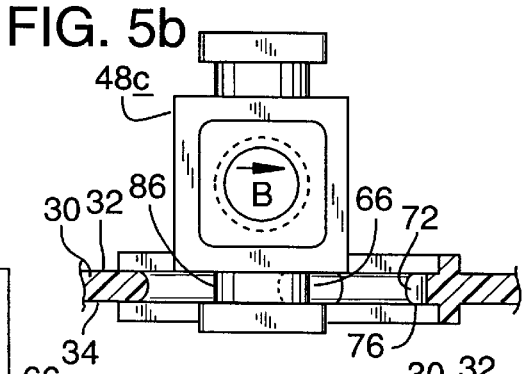
FIGS. 5*a*–5*c* are sectional views taken from FIGS. 4*b*–4*d* showing the coupler in the insertion area (FIG. 5*a*), shifted into the transition area (FIG. 5*b*) and finally shifted into the clasping area (FIG. 5*c*).
Figure 5A:
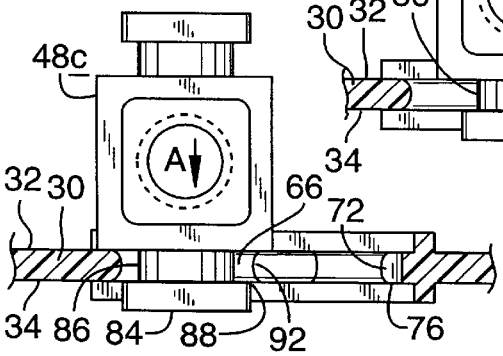
Figure 5C:
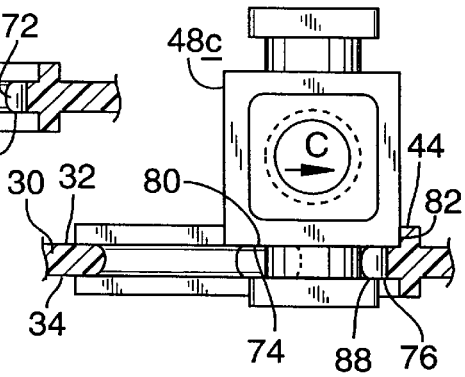

FIG. 3 shows an enlarged view of a coupler 48*c* positioned above outer face 32 at one of mounting sites 36 which includes aperture 42 and U-shaped guide 44. The aperture, which is best seen in FIG. 4*a,* is deformed by a beveled edge 92. Aperture 42 includes an insertion area 64, a transition channel 66 defined by straight sides 92*b* of beveled edge 92 extending from contact points 67 to locking points 68, a clasping area 70 defined by curved sides 92*a* of beveled edge 92, and a cutout area 72. The clasping area is surrounded by a first locking area 74 on outer face 32. As shown in FIGS. 5*a*–5*c*, a second locking area 76 is provided on inner face 34 and is identical to the first locking area on the outer face. Arrow A (FIG. 3) indicates the path the coupler takes when being inserted vertically into insertion area 64. Arrows B and C indicate the path the coupler takes when being shifted horizontally or laterally through transition channel 66 into clasping area 70.

Coupler 48*c*, as shown in FIG. 3, has a unitary structure preferably molded of plastic in a single piece, with no moving parts. The coupler includes a generally cube-shaped body 78, having six faces 80, three of which are shown, each face presenting a square shoulder 82 at the edges of the face. Four of faces 80 on coupler 48*c* include a peg 84 rigidly attached roughly at the center of each of the four faces and extending perpendicularly away from the face. Each peg 84 includes a cylindrical neck 86 rigidly coupled at an end to the face and a generally square peg head 88 rigidly mounted at an opposite end of peg neck 86. Each peg also includes an axial hole 90 extending through the center of peg 84 from the peg head, through the neck and down to coupler face 80. Peg neck 86 is smaller in diameter than the width of peg head 88 which in turn is smaller in width than coupler face 80.

Coupler 48*c* is similar to couplers 48, 48*a*, and 48*b* except that it includes only four pegs as opposed to the six pegs on the other couplers. The couplers can be made with any number of pegs from one to six. The coupler may also include other attachment devices such as holes (not shown) extending through the body for attaching other types of building pieces such as rods or tubes (not shown). Such holes may be coaxial with, and communicate with, axial holes 90 through pegs 84 or they may extend through coupler faces that do not include pegs. There are also building system components (not shown) that combine a coupler face and peg at one end with a spar-type connection at an opposite end.

Figure 4B:
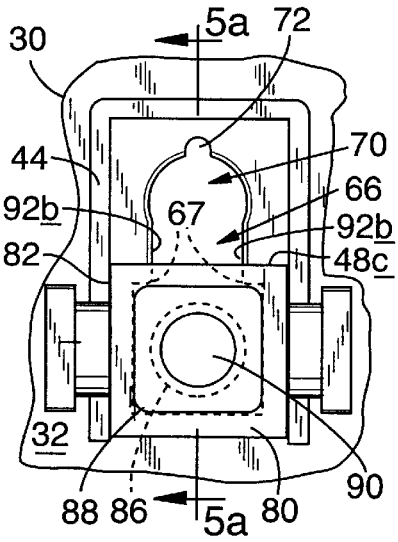
FIG. 4*b* shows the coupler placed in the insertion area.
Figure 4C:
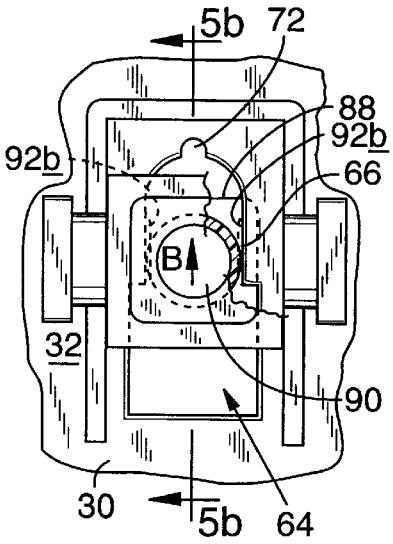
FIG. 4*c* shows the coupler shifted into the transition channel.

As seen in FIG. 3, and also FIGS. 4*b*–4*c*, peg head 88 is slightly smaller than insertion area 64 and thus passes through when inserted vertically into the insertion area. Coupler face 80, however, is wider than insertion area 64 and thus comes to rest on outer face 32 when the peg is inserted. Coupler face 80 is slightly narrower than the width of U-shaped guide 44 and so shoulder 82 butts against the guide when the peg is placed in the insertion area. Each coupler is thus aligned by the guide to the same rotational orientation about a vertical axis perpendicular to expanse 30.

As best seen in FIG. 4*a,* aperture 42 is surrounded by a beveled edge 92 of expanse 30. The beveled edge includes curved sides 92*a* around clasping area 70 and straight sides 92*b* along transition channel 66. The purpose of the beveled edge will shortly become apparent. As shown in FIG. 4*b*, coupler 48*c* is inserted vertically into the aperture so that one of the pegs extends into the insertion area. FIG. 5*a* is a sectional view with the coupler in the same position as FIG. 4*a* and illustrates that peg 84 is sized so that peg head 88 is even with inner face 34 when the peg is inserted. The peg may alternatively be sized so that the peg head is slightly above inner face 34. As shown in FIGS. 4*c* and 5*b*, the coupler is then shifted manually by the child so that peg neck 86 is moved into transition channel 66. Peg head 88 below the lower face of the coupler can be seen in the cutaway portion of FIG. 4*c*. Since peg head 88 is wider than transition channel 66, the expanse 30 around the transition channel is trapped between coupler face 80 and peg head 88. If the peg is sized to place peg head 88 slightly above inner face 34, expanse 30 is compressed between the coupler face and peg head. Beveled edge 92 facilitates the movement of the peg neck into the transition channel by allowing a gradual compression of expanse 30.

In FIG. 4*b*, peg neck 86 on the lower face of the coupler, which is in insertion area 64, is shown in dotted line. Peg neck 86 has a diameter slightly larger than the width of transition channel 66. As the peg neck is shifted into transition channel 66, the peg neck presses against contact points 67 causing the contact points and the sides 92*b* of the transition channel to spread apart. The sides 92*b* can be seen in FIG. 4*c* to be spread apart to allow the peg neck to shift through the transition channel which is thereby expanded in width. Transition channel 66 is expandable due to the resilience of the expanse material and also due to flexing facilitated by clasping area 70 and cutout area 72. Thus, the peg neck can be forced manually through the transition channel. The cutout area also reduces strain on the plastic material of the expanse surrounding the aperture. The strain occurs as the peg neck is shifted through the transition channel and is held in the clasping area. The reduction in strain reduces the likelihood of tearing or cracking of the expanse. Axial hole 90 also makes peg neck 86 more flexible thereby reducing the strain on the expanse and facilitating shifting of the peg neck through the transition channel and into the clasping area.

Figure 4D:
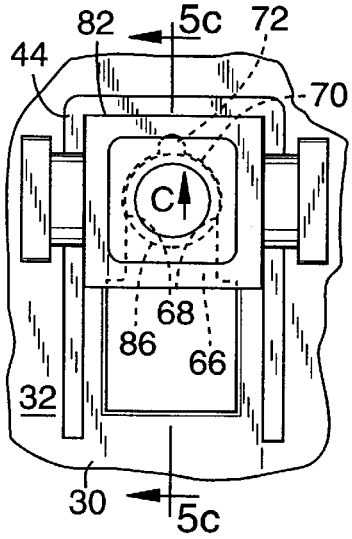
FIG. 4*d* shows the coupler shifted into a locked position in the clasping area.

FIGS. 4*d* and 5*c* show the coupler with peg neck 86 moved through transition channel 66 into a locked position in clasping area 70. In the locked position with the peg neck in the clasping area, the coupler is held in detachable retention by several forces. First, clasping area 70 is sized to fit tightly around the peg neck. Second, locking points 68 prevent the peg neck from moving back into transition channel 66. Third, coupler face 80 contacts first locking area 74 while peg head 88 contacts second locking area 76 preventing any vertical displacement of the coupler. As suggested above, the peg may be sized so that expanse 30 is compressed at the locking areas between the coupler face and the peg head, further discouraging vertical displacement and other movement of the coupler. In addition, rotation of the coupler about a vertical axis is prevented by guide 44 which shoulder 82 butts up against on three sides in the locked position. As described above, the coupler in the locked position provides a starting point for a model constructed of building system components.

The coupler may be detached from the mounting sites by retracting the coupler horizontally from the clasping area, in the reverse direction of arrow C of FIG. 5*c*, through the transition channel in the reverse direction of arrow B in FIG. 5*b*, into the insertion area. From the insertion area, the coupler may be withdrawn vertically from the mounting site in the reverse direction of arrow A in FIG. 5*a*.

While the present invention has been shown and described with reference to the foregoing preferred and alternate embodiments, it is to be understood by those skilled in the art that other changes in form and detail may be made therein without departing from the spirit and scope of the invention as defined in the appended claims.

I claim:

1. A carrying case for storing and mounting a plurality of building pieces and couplers, each coupler having a face with a peg extending therefrom, the peg including a peg head at an end of the peg opposite the face, the coupler face having a shoulder, the case comprising:

an enclosure for storing the building pieces and couplers, the enclosure including an expanse having opposed first and second faces, the expanse further having a site for mounting one of the couplers, the site having an aperture extending from the first face to the second face, the site further having a first locking area on the first face adjacent the aperture and a second locking area on the second face adjacent the aperture, the site being adapted for receiving and securing the coupler in a locked position wherein the coupler face contacts the first locking area and the peg head contacts the second locking area thereby preventing vertical displacement of the coupler and further wherein the aperture includes an insertion area and a clasping area, the insertion area sized to allow passage therethrough of the peg head but preventing passage of the coupler face, the clasping area sized to prevent the passage therethrough of the peg head, so that the coupler may be first received vertically in the insertion area and then shifted laterally to the locked position in the clasping area, and wherein the mounting site further includes a first guide disposed on the first face adjacent the aperture so that, in the locked position, the shoulder is in contact with the first guide and the first guide prevents rotation of the coupler about a vertical axis.

2. The carrying case of claim 1 wherein the guide has a U-shape configured to be butted against on three sides by the shoulder to prevent rotation of the coupler about the vertical axis in the locked position.

3. The carrying case of claim 1 wherein the enclosure includes a lid for selectively opening and closing the enclosure and wherein the expanse having the coupler-mounting site is part of the lid.

4. The carrying case of claim 1 wherein the expanse includes a plurality of identical sites for mounting the couplers, the sites being arranged in an array whereby the building pieces can be used to interconnect the couplers mounted on the sites.

5. The carrying case of claim 1 wherein the mounting site further includes a second guide on the second face so that the coupler can be inserted into the locked position from either side of the expanse and both faces can be used as a work surface for mounting the building pieces and couplers.

6. A carrying case and toy building system comprising:

a plurality of building pieces and couplers, each coupler having a face with a peg extending therefrom, the peg including a peg head at an end of the peg opposite the face, the coupler face having a shoulder;

an enclosure for storing the building pieces and couplers, the enclosure including an expanse having opposed first and second faces, the expanse further having a site for mounting one of the couplers, the site having an aperture extending from the first face to the second face, the site further having a first locking area on the first face adjacent the aperture and a second locking area on the second face adjacent the aperture, the site being adapted for receiving and securing the coupler in a locked position wherein the coupler face contacts the first locking area and the peg head contacts the second locking area thereby preventing vertical displacement of the coupler and further wherein the aperture includes an insertion area and a clasping area, the insertion area sized to allow passage therethrough of the peg head but preventing passage of the coupler face, the clasping area sized to prevent the passage therethrough of the peg head, so that the coupler may be first received vertically in the insertion area and then shifted laterally to the locked position in the clasping area, and wherein the mounting site further includes a first guide disposed on the first face adjacent the aperture so that, in the locked position, the shoulder is in contact with the first guide and the first guide prevents rotation of the coupler about a vertical axis.

7. The carrying case of claim 6 wherein each of the coupler pegs includes a neck between the coupler face and the peg head and wherein the aperture includes a transition channel between the insertion area and the clasping area, the channel being narrower than the peg neck and expandible to permit the peg neck of the coupler to be shifted manually from the insertion area through the transition channel into the clasping area for detachable retention therein.

8. The carrying case of claim 7 wherein the aperture includes a cutout area to facilitate expansion of the transition channel when the coupler is shifted through the channel.

9. The carrying case of claim 6 wherein the coupler peg is sized so that the peg head, when placed in the insertion area, is slightly above the second face of the expanse so that, when the coupler is shifted to the clasping area, the expanse is compressed between the coupler face and the peg head.

10. The carrying case of claim 9 wherein the expanse includes a beveled edge adjacent the aperture thereby facilitating compression of the expanse.

11. The carrying case of claim 6 wherein the clasping area is sized to fit tightly around the peg when the coupler is in the locked position.

* * * * *